US009551488B2

(12) United States Patent
Akagi

(10) Patent No.: US 9,551,488 B2
(45) Date of Patent: Jan. 24, 2017

(54) FLAT BURNER

(71) Applicant: Rinnai Corporation, Nagoya-shi, Aichi (JP)

(72) Inventor: Kazuyuki Akagi, Nagoya (JP)

(73) Assignee: RINNAI CORPORATION, Nagoya-shi, Aichi (JP)

( * ) Notice: Subject to any disclaimer, the term of this patent is extended or adjusted under 35 U.S.C. 154(b) by 323 days.

(21) Appl. No.: 14/310,796

(22) Filed: Jun. 20, 2014

(65) Prior Publication Data

US 2015/0369478 A1 Dec. 24, 2015

(51) Int. Cl.

| | |
|---|---|
| ***F23D 14/02*** | (2006.01) |
| ***F23D 14/58*** | (2006.01) |
| ***F23D 14/04*** | (2006.01) |
| ***F23D 14/10*** | (2006.01) |

(52) U.S. Cl.

CPC ..... *F23D 14/586* (2013.01); *F23D 14/045* (2013.01); *F23D 14/105* (2013.01)

(58) Field of Classification Search

CPC ..... F23D 14/586; F23D 14/105; F23D 14/045
See application file for complete search history.

(56) References Cited

U.S. PATENT DOCUMENTS

| | | | |
|---|---|---|---|
| 3,958,762 | A | 5/1976 | Godijn |
| 5,661,905 | A | 9/1997 | Nakaura et al. |
| 2003/0143507 | A1 | 7/2003 | Kuriyama et al. |
| 2012/0308945 | A1 | 12/2012 | Wada et al. |

FOREIGN PATENT DOCUMENTS

| | | | |
|---|---|---|---|
| JP | 0514629 | A | 6/1993 |
| JP | 07-091620 | A | 4/1995 |
| JP | 2002349813 | A | 12/2002 |
| JP | 2008286448 | A | 11/2008 |

(Continued)

OTHER PUBLICATIONS

Office Action dated Mar. 1, 2016, issued in counterpart Japanese Patent Application No. 2013-040541, with English translation. (6 pages).

(Continued)

*Primary Examiner* — Alfred Basichas
(74) *Attorney, Agent, or Firm* — Westerman, Hattori, Daniels & Adrian, LLP

(57) ABSTRACT

A flat burner has at an upper end thereof a rectangular flame port portion which has a straightening member with a plurality of straightening plates laterally disposed in parallel with one another. The straightening member has contact portions in which the straightening plates are brought into contact with one another at a plurality of longitudinal positions to thereby longitudinally segregate the flame port passages that are defined by each of the straightening plates. Out of the contact portions of the laterally inside straightening plates defining the laterally center-side flame port passages of the flame port portion, at least lower half of the contact portions that are positioned at least in predetermined longitudinal portions is formed into an inverse triangle as seen in the lateral direction. The predetermined longitudinal portions are those in which the inlet direction of flow of the fuel-air mixture from the distribution chamber portion into the flame port portion longitudinally inclines relative to a vertical direction beyond a predetermined angle.

4 Claims, 8 Drawing Sheets

(56) References Cited

FOREIGN PATENT DOCUMENTS

JP 2010-261619 A 11/2010

OTHER PUBLICATIONS

Office Action dated Apr. 29, 2015, issued in corresponding Italian Patent Application No. RM2014A000453, with English translation (3 pages).
Search Report dated Apr. 21, 2015, issued in corresponding Italian Patent Application No. RM20140453 with Written Opinion (7 pages).

FLAT BURNER

BACKGROUND OF THE INVENTION

1. Technical Field

The present invention relates to a flat burner for use in a combustion apparatus such as a heat source apparatus for hot water supply and the like.

2. Background Art

Generally, in a heat source apparatus for hot water supply, a plurality of flat burners each having a rectangular flame port portion at an upper end thereof is disposed in parallel with one another in a combustion box which forcibly supplies combustion air by means of a combustion fan.

Conventionally, this kind of flat burner with a flame port portion has a burner main body which is made up of a pair of side plates lying opposite to each other in a lateral direction where a longitudinal direction of the flame port portion is defined as a back-and-forth direction and a width direction of the flame port portion is defined as a lateral direction. The burner main body has formed therein a mixing tube portion at a lower part of the burner main body, and a distribution chamber portion which introduces a fuel-air mixture from the mixing tube portion into the flame port portion. The flame port portion has mounted therein a straightening member with a plurality of straightening plates laterally disposed in parallel with one another (see, for example, JP-A-1995-91620). The straightening member has contact portions in which the straightening plates are brought into contact with one another at a plurality of longitudinal positions to thereby longitudinally segregate the flame port passages that are defined by each of the straightening plates.

By the way, in order to downsize the heat source apparatus, it is sometimes required that the vertical dimensions of the distribution chamber portion of the flat burner be shortened. However, should the vertical dimensions of the distribution chamber portion be shortened, the inlet direction of flow of the fuel-air mixture from the distribution chamber portion into the flame port portion at the front part and the rear part of the flat burner will largely be inclined longitudinally relative to the vertical direction. Here, in the laterally center-side of the flame port passage, the flow velocity of the fuel-air mixture becomes larger and the flame formed over the flame port passage becomes large. Then, if the inlet direction of flow of the fuel-air mixture into the flame port passage in the laterally center-side of the front part and the rear part of the burner becomes largely inclined longitudinally, the large flame formed in this flame port portion over the flame port passage will be inclined longitudinally. As a result, the front surface and the rear surface of the combustion box will be intensely heated, thereby giving rise to a heat loss of the combustion box.

SUMMARY

Problems that the Invention is to Solve

In view of the above points, this invention has a problem of providing a flat burner in which, even if the inlet direction of flow of the fuel-air mixture into the laterally center-side flame port is largely inclined longitudinally, the flames to be formed over the flame port passages can be prevented from getting largely inclined longitudinally.

Means for Solving the Problems

In order to solve the above problem, this invention is a flat burner having at an upper end thereof a rectangular flame port portion, the flat burner comprising a burner main body constituted by a pair of side plates lying opposite to each other in a lateral direction where a longitudinal direction of the flame port portion is defined as a back-and-forth direction and a width direction of the flame port portion is defined as a lateral direction. The burner main body comprises a mixing tube portion formed at a lower part thereof, and a distribution chamber portion which introduces a fuel-air mixture from the mixing tube portion to the flame port portion. The flame port portion has mounted therein a straightening member with a plurality of straightening plates laterally disposed in parallel with one another, the straightening member having contact portions in which the straightening plates are brought into contact with one another at a plurality of longitudinal positions to thereby longitudinally segregate flame port passages defined by each of the straightening plates. Out of the contact portions of the laterally inside straightening plates defining the laterally center-side flame port passages of the flame port portion, at least lower half of the contact portions that are positioned at least in predetermined longitudinal portions is formed into an inverse triangle as seen in the lateral direction. The predetermined longitudinal portions are those in which the inlet direction of flow of the fuel-air mixture from the distribution chamber portion into the flame port portion longitudinally inclines relative to a vertical direction beyond a predetermined angle.

According to this invention, in case the fuel-air mixture flows into the laterally center-side flame port passage in a state of being largely inclined longitudinally, the fuel-air mixture that collides against the inverse triangle portions of the contact portions will rebound in the longitudinal direction that is opposite to the inlet direction of flow of the fuel-air mixture with a relatively large component of velocity. Then, accompanied by the rebound flow, the flow of the fuel-air mixture is directed upward also at the flow passage portion away from the contact portion. As a result, even if the inlet direction of flow of the fuel-air mixture into the flame passage which is closer to the laterally center-side flame port portion is largely inclined in the longitudinal direction, the flames to be formed over the flame port passages can be prevented from largely inclining longitudinally.

According to this invention, preferably the pitch of disposing the contact portions is narrowed in the longitudinal direction at the predetermined portions. According to this arrangement, the flow of the fuel-air mixture flowing into the flame port passage in the longitudinally inclined state can be moved toward upper direction more effectively.

In addition, according to this invention, the flat burner preferably further comprises sub-contact portions which bring the laterally inner-side straightening plates into contact with one another at intermediate lower part at the pitch of disposing the contact portions 68*c*. Further, out of the sub-contact portions, those located at the predetermined longitudinal portions are inclined in a longitudinal direction opposite to the inlet direction of flow of the fuel-air mixture. According to the above-mentioned arrangement, the flow of the fuel-air mixture flowing into the flame port passage in a state of inclined in the longitudinal direction can be moved toward upper direction more surely.

DESCRIPTION OF PREFERRED EMBODIMENTS

Figure 1:
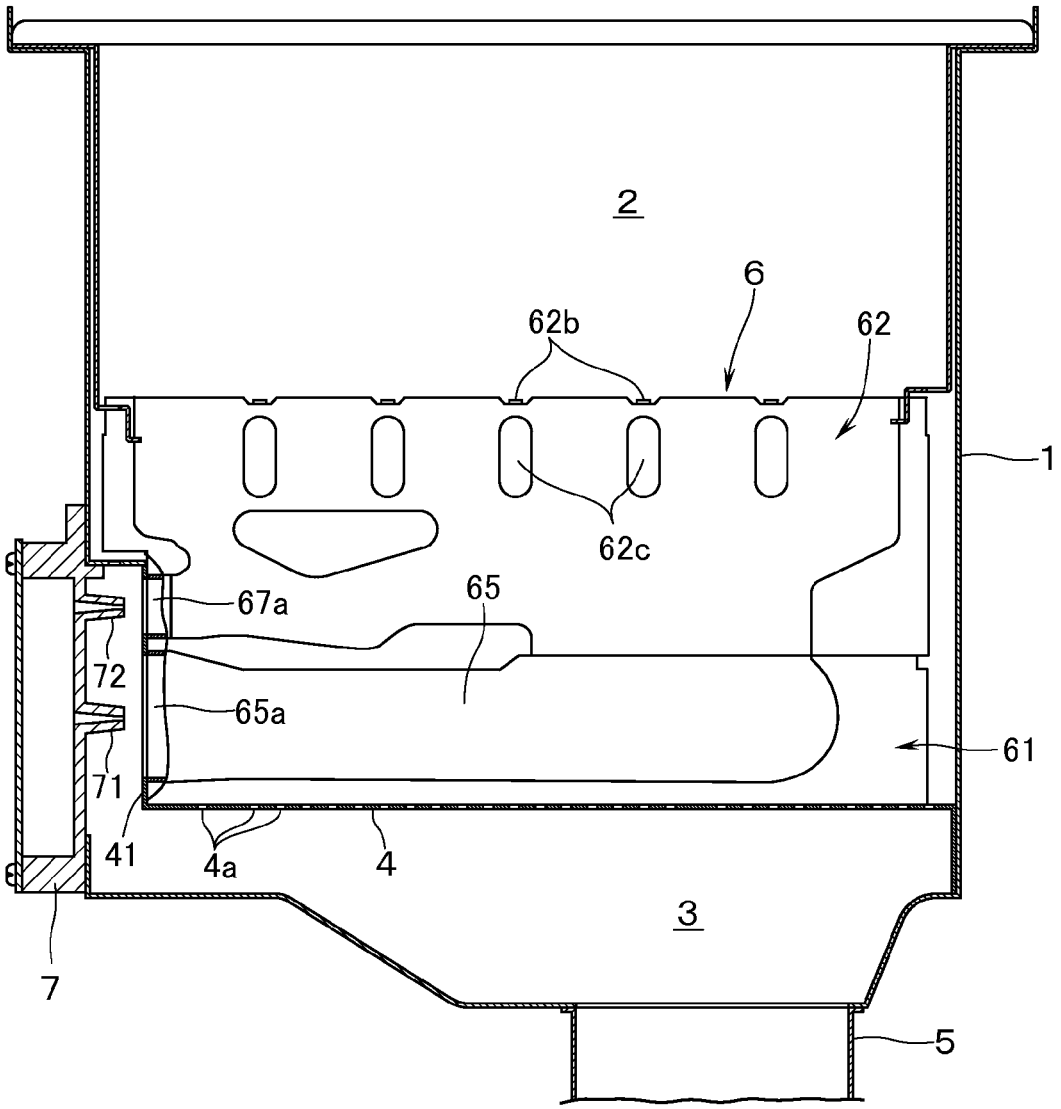
FIG. 1 is a sectional side view of a combustion apparatus equipped with a flat burner of an embodiment according to this invention.

With reference to FIG. 1, reference numeral 1 denotes a combustion box which constitutes a combustion apparatus such as a heat source apparatus for supplying hot water, and the like. The upper surface of the combustion box 1 is left open and an object to be heated such as a heat exchanger and the like (not illustrated) is disposed on top of the combustion box. Inside the combustion box 1 there is provided a partition plate 4 which partitions the space inside the combustion box 1 into a combustion chamber 2, and an air supply chamber 3 which lies to the lower side of the combustion chamber 2. The bottom surface of the air supply chamber 3 has connected thereto a combustion fan (not illustrated) through a duct 5 so that air can be supplied from the combustion fan to the air supply chamber 3. The partition plate 4 has formed therein a multiplicity of distribution holes 4*a* so that the air supplied to the air supply chamber 3 can be supplied as secondary air to the combustion chamber 2 through these distribution holes 4*a*.

A plurality of flat burners 6 according to an embodiment of this invention is disposed inside the combustion chamber 2. A riser portion 41 is formed in a bent manner at the front edge of the partition plate 4. A manifold 7 is mounted at the front side of the riser portion 41 in a manner to block the lower front face of the combustion box 1. The manifold 7 is provided with gas nozzles 71, 72 which face the inlet ports 65*a*, 67*a* of mixing tube portions 65, 67 of each of the flat burners 6 as described hereinbelow. In this manner, each of the inlet ports 65*a*, 67*a* is supplied with a fuel gas from each of the gas nozzles 71, 72, and each of the inlet ports 65*a*, 67*a* is supplied with primary air from the air supply chamber 3 through the clearance to be defined between the riser portion 41 and the manifold 7.

Figure 2:
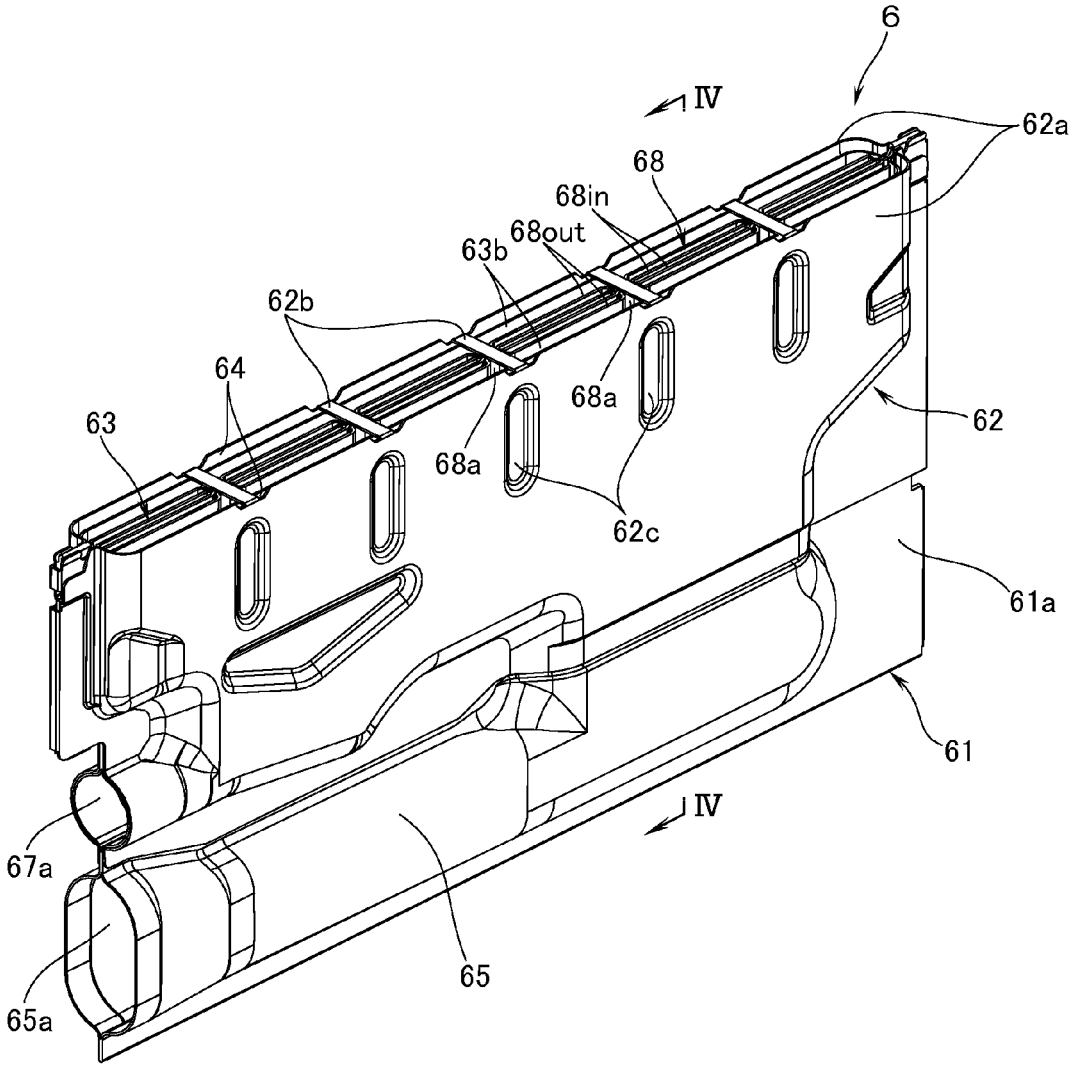
FIG. 2 is a perspective view of the flat burner according to this embodiment.
Figure 3:
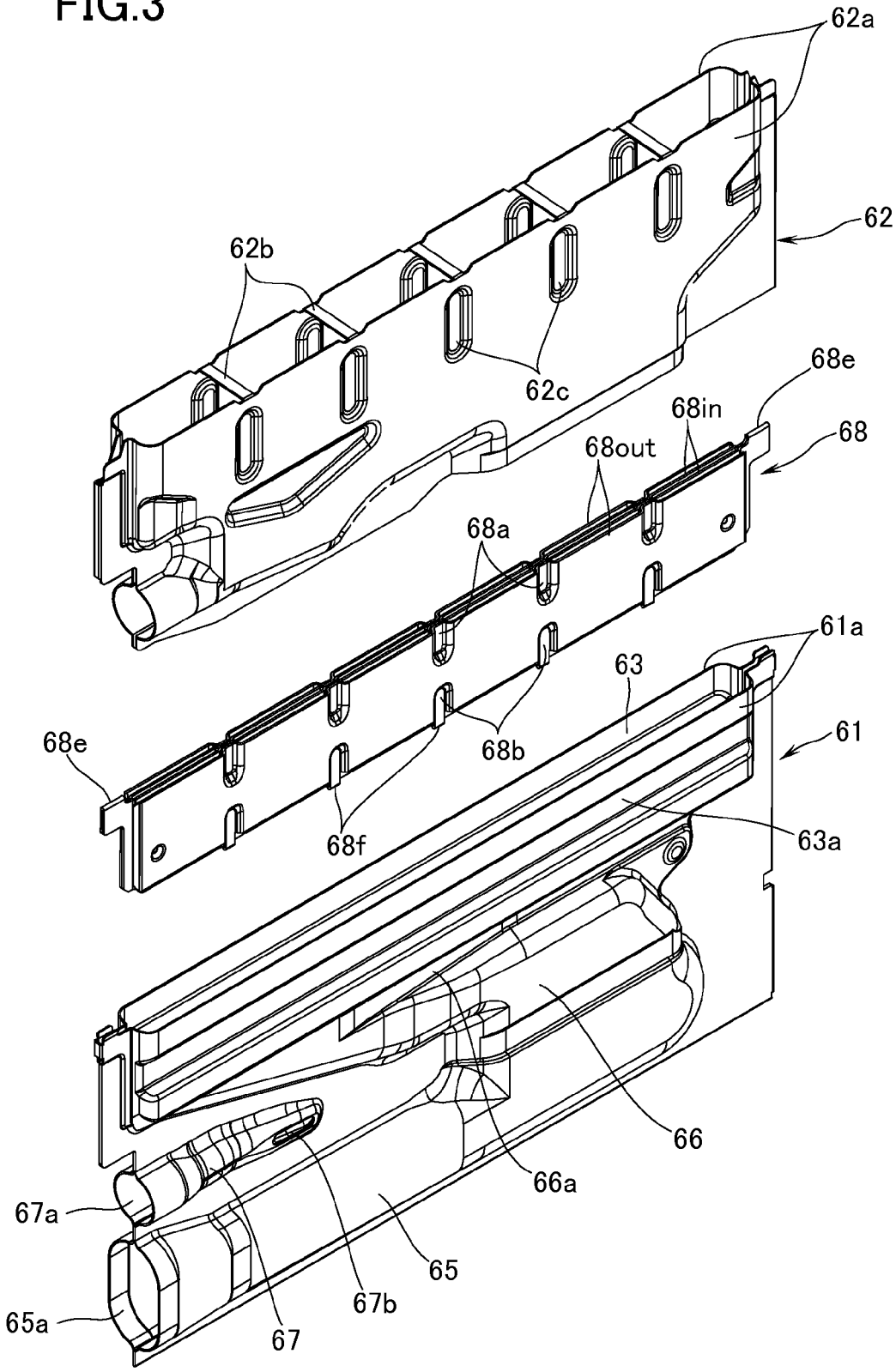
FIG. 3 is an exploded perspective view of the flat burner according to this embodiment.

As shown in FIGS. 2 and 3, the flat burner 6 is provided with a burner main body 61 and a burner cap 62 which is covered on top of the burner main body 61. A rectangular flame port portion 63 which opens upward is formed at an upper end of the burner main body 61. By means of the burner cap 62 there is formed a flame retention port portion 64 which is positioned on both sides of the flame port portion 63. A lean fuel-air mixture which is leaner in fuel concentration than a theoretical fuel-air ratio is ejected from the flame port portion 63, and a thick fuel-air mixture which is thicker in fuel concentration than the theoretical fuel-air ratio is ejected from the flame retention port portion 64, thereby performing so-called thick and thin fuel combustion.

Figure 4:
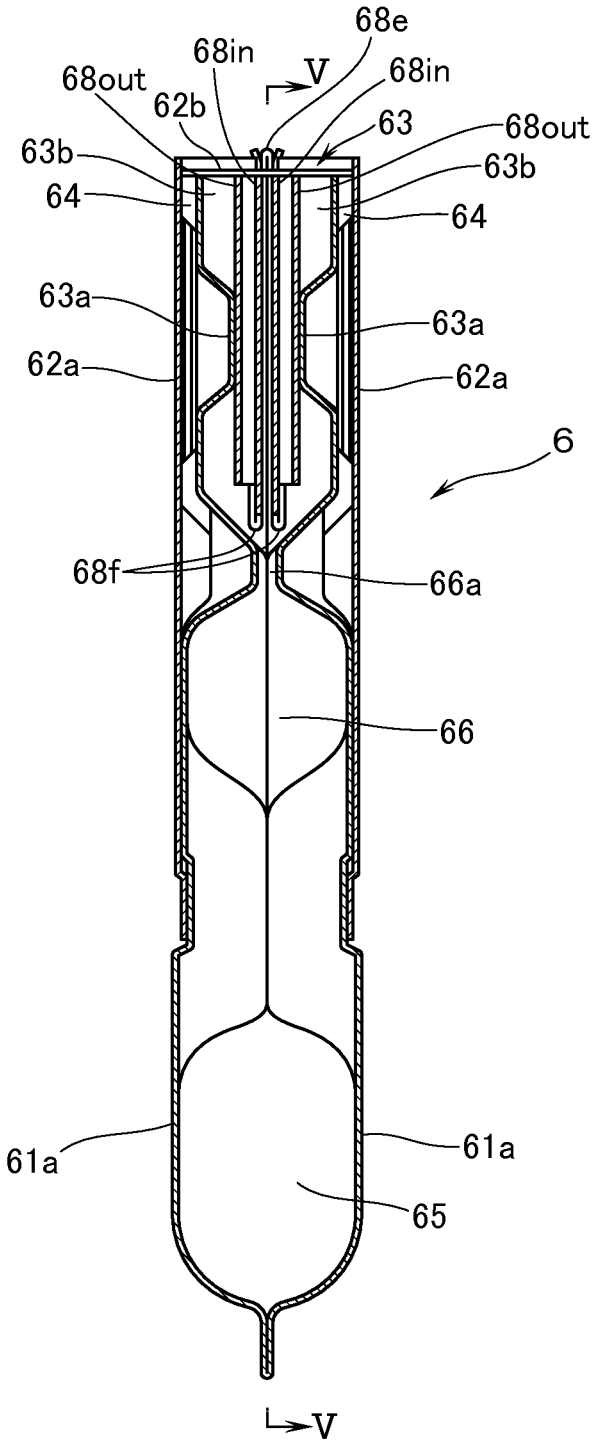
FIG. 4 is a sectional view of the flat burner taken along the line IV-IV in FIG. 2.

Detailed description will now be made of the construction of the flat burner 6, provided that the longitudinal direction of the flame port portion 63 is defined as a back-and-forth direction, and that the width direction of the flame port portion 63 is defined as a lateral direction. As shown in FIG. 4, the burner main body 61 is made up of a pair of side plates 61*a*, 61*a* which lie laterally opposite to each other. The side plates 61*a*, 61*a* are formed by bending a single piece of plate into a shape of a two-ply along a bending line which forms a bottom edge of the burner main body 61. Then, by means of press working of each of the side plates 61*a*, 61*a*, there are formed in the burner main body 61: the flame port portion 63 on an upper end; the mixing tube portion 65 at a lower part thereof; and a distribution chamber portion 66 which introduces the fuel-air mixture from the mixing tube portion 65 into the flame port portion 63.

The mixing tube portion 65 is elongated backward from the inlet port 65*a* which is positioned at a lower front edge of the burner main body 61, and the rear end part of the mixing tube portion 65 is bent upward so as to be communicated with the distribution chamber portion 66. At the front part of the burner main body 61 there is formed a mixing tube portion 67 for flame retention purpose (referred to as "flame retention mixing tube portion") at a position between the mixing tube portion 65 and the distribution chamber portion 66. This flame retention mixing tube portion 67 ends up by extending slightly backward from the inlet port 67*a* that is located at the front edge of the burner main body 61. At a side surface of the rear end part of the flame retention mixing tube portion 67, there is formed a ventilation hole 67*b*.

The burner cap 62 has: a pair of side plates 62*a*, 62*a* which are covered onto an outside of the pair of side plates 61*a*, 61*a* of the burner main body 61; and a plurality of longitudinally disposed bridge portions 62*b* which connect the side plates 62*a*, 62*a* together at the upper edges thereof. Between the side plate 61*a* of the burner main body 61 and the side plate 62*a* of the burner cap 62, there are defined: a flame retention port portion 64 at an upper edge portion; and a passage which introduces the fuel-air mixture into the flame retention port portion 64, the fuel-air mixture being escaped from the flame retention mixing tube portion 67 to the outside of the burner main body 61 through the ventilation hole 67*b*. In addition, at a plurality of longitudinal positions of the side plate 62*a* of the burner cap 62, there are formed recessed portions 62*c* which are in contact with the outside surface of the side plate 61*a* of the burner main body 61 in a manner to longitudinally segregate the flame retention port portion 64.

Inside the flame port portion 63, there is mounted a straightening member 68 having a plurality of straightening plates which are laterally disposed in parallel with one another. In this embodiment, the straightening member 68 is constituted by two laterally inside straightening plates 68in, 68in, and two laterally outside straightening plates 68out, 68out. In a vertically intermediate part of the flame port portion 63 of the burner main body 61, there are formed dented (or narrowed) portions 63*a* which sandwich the straightening member 68 from both lateral sides. According to this arrangement, there are defined blind clearances 63*b* which are free from ejection of the fuel-air mixture, the blind clearances being defined between those parts of the side plates 61*a* which are present above the dented portions 63*a* and the outside straightening plate 68out.

The straightening member 68 has the following contact portions at a plurality of longitudinally disposed positions that coincide with the bridge portions 62*b* of the burner cap 62, namely: a pair of upper and lower contact portions 68*a*, 68*b* which longitudinally segregate the flame port passages which are defined between both the straightening plates 68in, 68out by bringing the inside straightening plates 68in and the outside straightening plates 68out into contact with each other; and contact portions 68*c* (see FIG. 5) which are formed by bringing the two inside straightening plates 68in, 68in into contact with each other to thereby longitudinally segregate the flame port passages positioned on laterally center side of the flame port portion 63 to be defined between the inside straightening plates 68in, 68in. Further, the straightening member 68 has sub-contact portions 68*d* which bring the inside straightening plates 68in, 68in into contact with each other at an intermediate lower part at the pitch of disposing the contact portions 68*c*. In addition, the inside straightening plates 68in, 68in are coupled together at the connecting portions 68*e* on both front and rear ends. The inside straightening plate 68in and the outside straightening plate 68out are coupled together by means of coupling portions 68*f* which are disposed on a plurality of longitudinal positions of a lower edge of the straightening plates.

On an upper part of the distribution chamber portion 66, there is formed a constricted portion 66*a* with a reduced lateral width. The lateral width of the constricted portion 66*a* is gradually expanded from the rear part which is the position of inlet of the fuel-air mixture from the mixing tube portion 65 toward the front part of the distribution chamber portion 66. According to this arrangement, the longitudinal flow distribution of the fuel-air mixture that flows into the flame port portion 63 is equalized.

Figure 5:
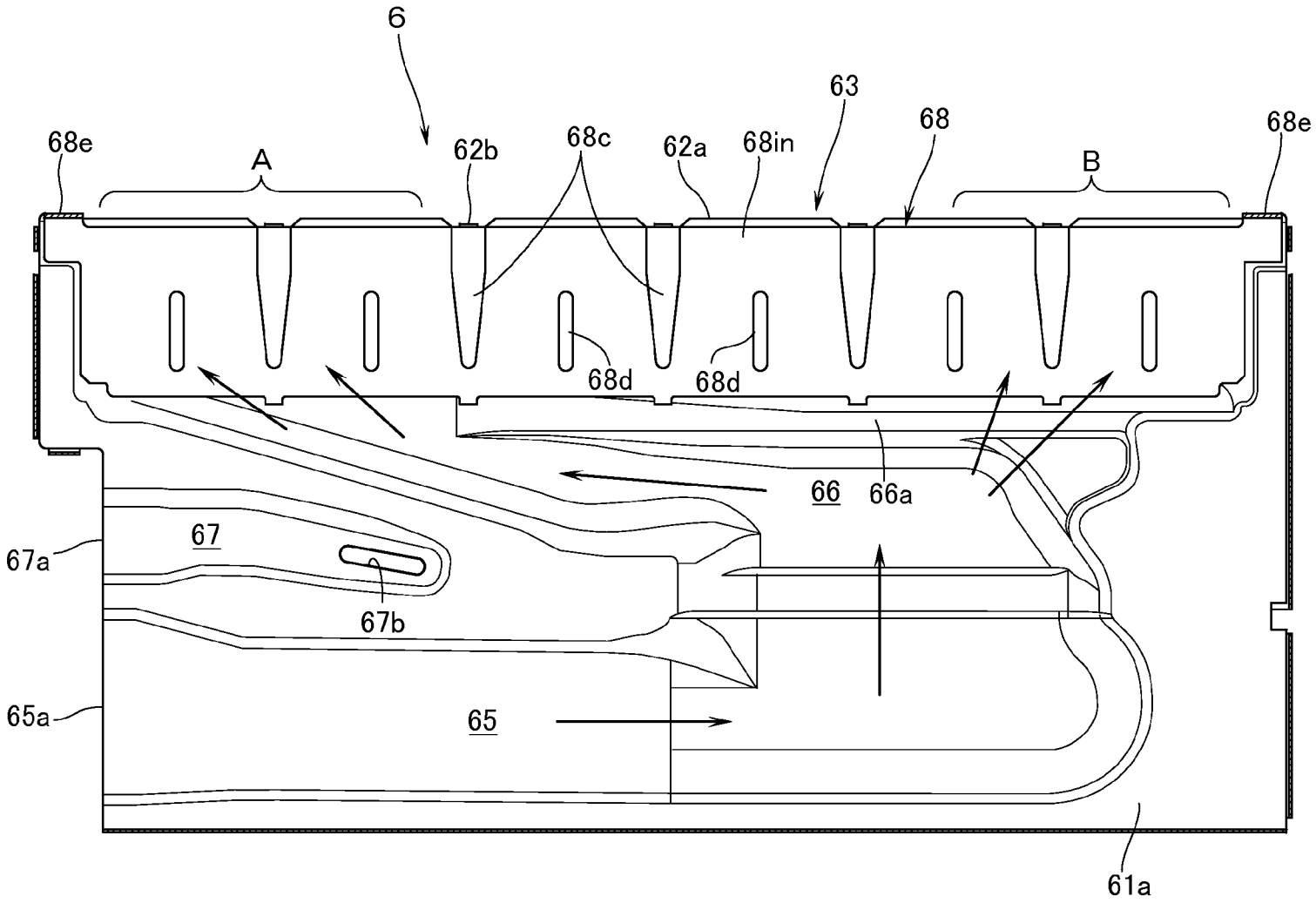
FIG. 5 is a sectional side view taken along the line V-V in FIG. 4.
Figure 6:
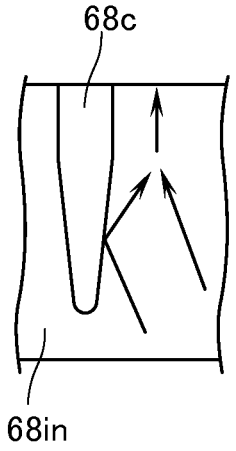
FIG. 6 is a partial front view of the flat burner explaining the function of this invention.

By the way, if the vertical dimensions of the distribution chamber portion 66 are shortened, in a portion shown by "A" in FIG. 5 of the burner front portion, the inlet direction of flow of the fuel-air mixture from the distribution chamber portion 66 into the flame port portion 63 will be inclined forward relative to the vertical direction beyond a predetermined angle (e.g., 10-15 degrees). In addition, in a portion at the back of the burner shown by "B" in FIG. 5, the inlet direction of flow of the fuel-air mixture from the distribution chamber portion 66 into the flame port portion 63 will be inclined backward relative to the vertical direction beyond a predetermined angle (e.g., 5-10 degrees). Here, in the laterally inner-side flame port passage of the flame port portion 63, the flow velocity of the fuel-air mixture will be higher and the flame that is formed over the flame port passage will become larger. If the inlet direction of flow of the fuel-air mixture into the laterally center-side flame port passage at the front part or rear part of the burner is longitudinally inclined largely, the large flame that is formed over the flame port passage will be longitudinally inclined. As a result, the front surface or the rear surface of the combustion box 1 will be intensively heated, thereby resulting in a heat loss in the combustion box 1.

As a solution, according to this embodiment, the lower half of the respective contact portion 68*c* between the inside straightening plates 68in, 68in is formed, as shown in FIG. 5, in a manner to form an inverse triangle as seen in the lateral direction. According to this arrangement, in case the fuel-air mixture flows into the laterally center-side flame port passage of the flame port portion 63 in a state in which the fuel-air mixture is largely inclined in the longitudinal direction, the fuel-air mixture collided against the inverse triangle portion at the lower half of the contact portion 68*c* will be bounded, with a relatively large velocity component, back toward the longitudinal direction that is opposite to the inlet direction of flow of the fuel-air mixture. Accompanied by this rebounding flow of the fuel-air mixture, the flow of the fuel-air mixture is directed upward also at the flame port passage portion that is away from the contact portion 68*c*. As a result, even in case the inlet direction of flow of the fuel-air mixture into the laterally center-side flame port passage of the flame port portion 63 is largely inclined longitudinally, the flame that is formed over the flame port passage can be prevented from largely inclining longitudinally. As a result, there will be generated no heat loss in the combustion box 1.

In the above-mentioned embodiment, all of the contact portions 68*c* between the inside straightening plates 68in, 68in are formed into a shape having an inverse triangle at the lower half. Alternatively, the following arrangement may be employed, namely, lower half portion having an inverse triangle may be formed only in the front part and the rear part of the burner as marked "A" and "B" in FIG. 5, i.e., only at the contact portions 68*c* that are positioned in a portion in which the inlet direction of flow of the fuel-air mixture from the distribution chamber portion 66 to the flame port portion 63 inclines longitudinally beyond a predetermined angle relative to the vertical direction. In addition, not only the lower half of the contact portion 68*c* but also the entire upper and lower body may be formed into an inverse triangle. Still furthermore, it is possible to omit the sub-contact portions 68*d* but, by providing the sub-contact portions 68*d*, the flow of the fuel-air mixture may advantageously be directed upward more efficiently.

Figure 7:
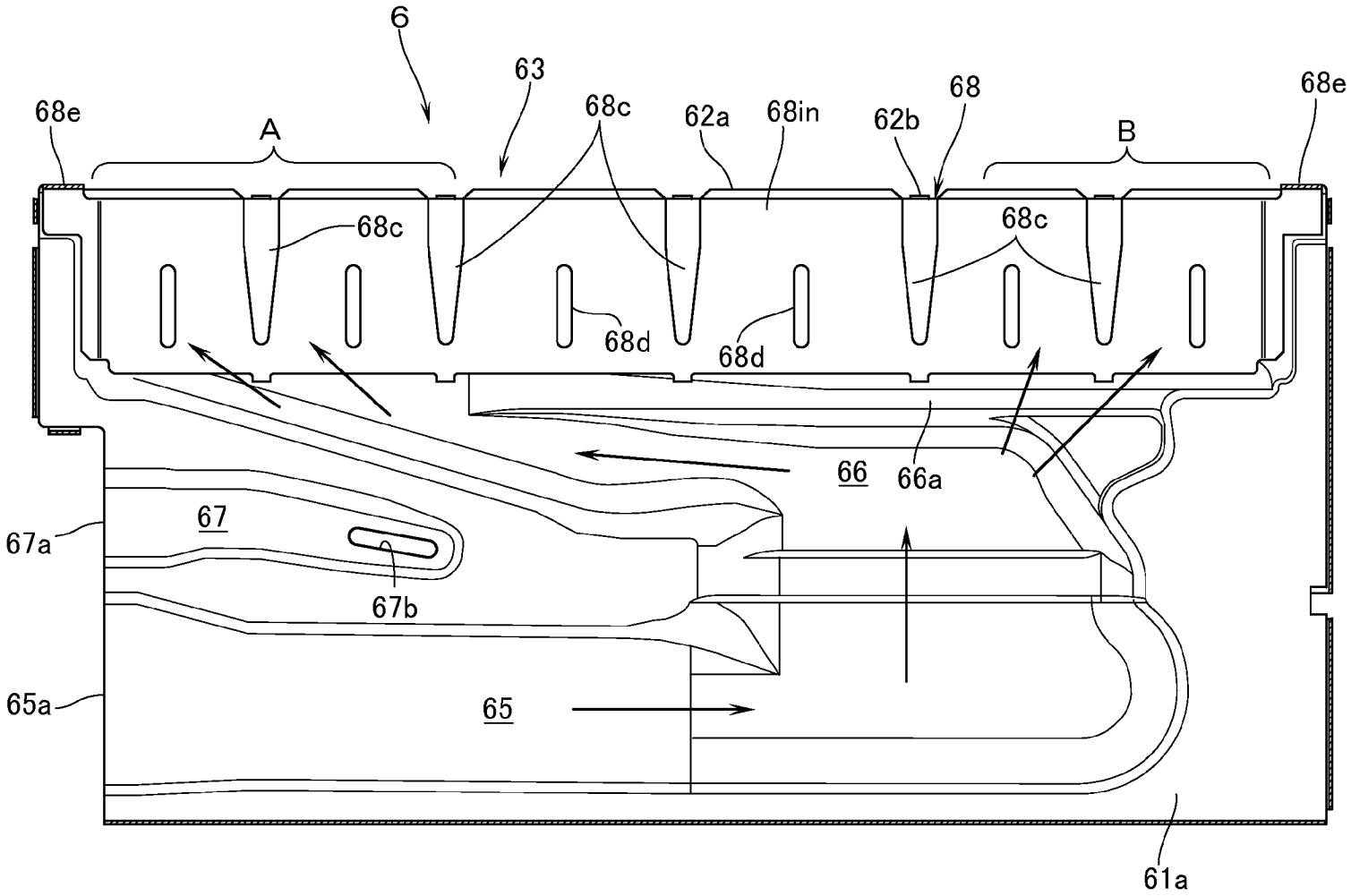
FIG. 7 is a sectional side view of the flat burner according to the second embodiment corresponding to FIG. 5.

Further, according to a second embodiment as shown in FIG. 7, the pitch at which the contact portions 68*c* are disposed may be narrowed at the front and rear parts as marked "A" and "B" of the burner as shown in FIG. 7. According to this arrangement, the flow of the fuel-air mixture at the parts "A" and "B" can be directed upward more positively.

Figure 8:
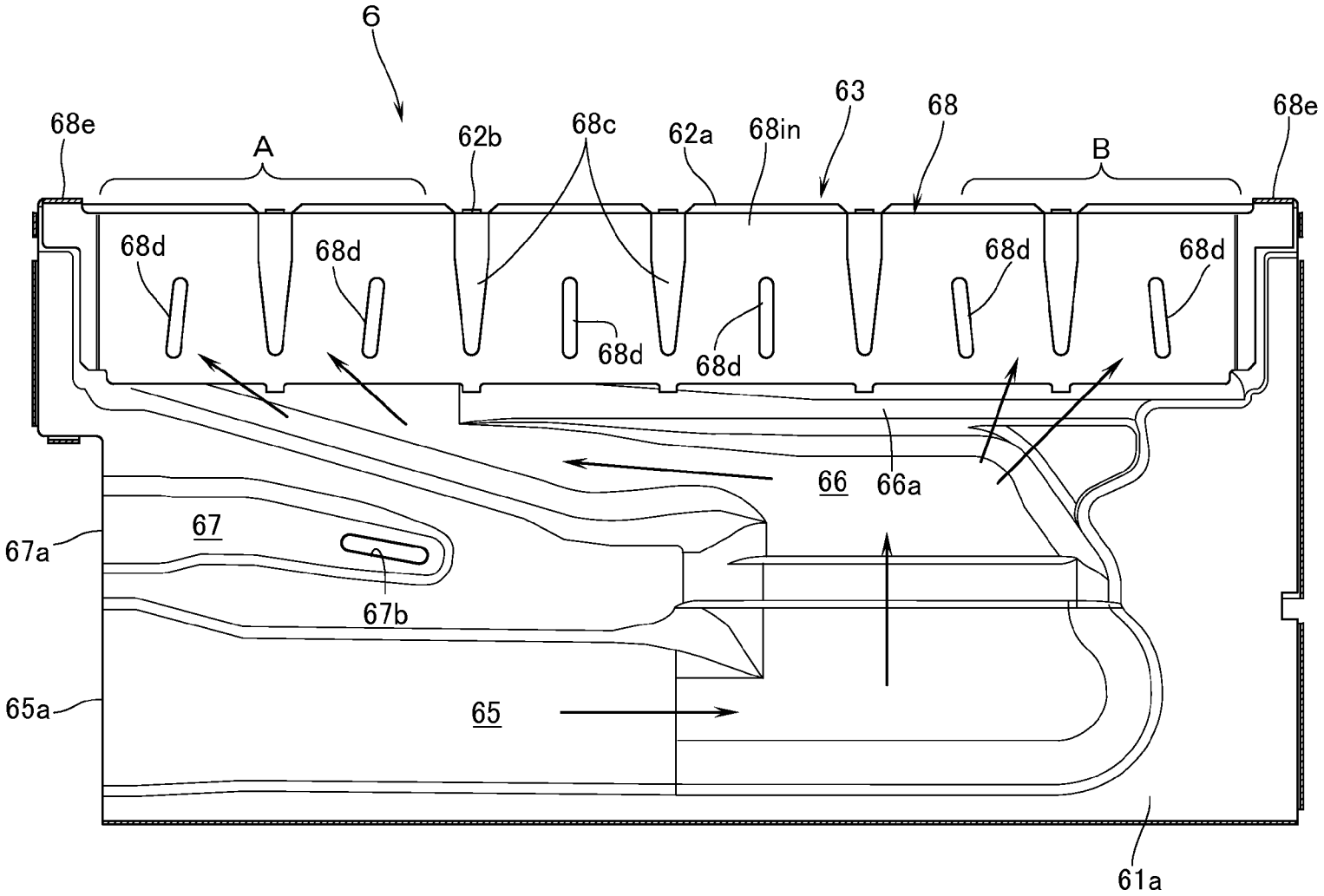
FIG. 8 is a sectional side view of the flat burner according to the third embodiment corresponding to FIG. 5.

Still furthermore, according to a third embodiment as shown in FIG. 8, the sub-contact portions 68*d* that are present at the parts "A" and "B" as marked in FIG. 8 may be inclined in the forward and the backward directions that are opposite to the inlet direction of the fuel-air mixture relative to the vertical direction. In other words, the sub-contact portion 68*d* that is positioned in part "A" where the inlet direction of flow of the fuel-air mixture inclines forward relative to the vertical direction, is caused to incline backward relative to the vertical direction. Further, the sub-contact portion 68*d* that is positioned in part "B" where the inlet direction of flow of the fuel-air mixture inclines backward relative to the vertical direction, is caused to incline forward relative to the vertical direction. In this arrangement, the flow of the fuel-air mixture at the parts "A" and "B" can be directed upward more positively.

Descriptions have so far been made of the embodiments of this invention with reference to the drawings, but this invention is not limited to the above. For example, in the above-mentioned embodiments, at least the lower half of the contact portions 68*c* of the inside straightening plates 68in, 68in is formed into an inverse triangle. But the lower half may be formed into an inverse triangle not only at the contact portions 68*c* of the inside straightening plates 68in, 68in, but also at least the lower half of the contact portions 68*a* of the inside and the outside straightening plates 68in, 68out may be formed into an inverse triangle.

In addition, the straightening plates 68 of the above embodiment has a four-plate construction, but may be made of a five-plate construction having a central straightening plate between the two inside straightening plates. In this case, since the flame port passage toward the laterally center-side flame port passage will be defined between the central straightening plate and each of the inside straightening plates, at least the lower half of the contact portions of the central straightening plate and each of the inside straightening plates is formed into an inverse triangle.

Further, the flat burner 6 according to the above embodiments is of a thick-and-thin fuel combustion type of burner provided with a burner cap 62. This invention is, however, applicable to the flat burner that is not of the thick-and-thin fuel type of burner in which the burner cap is omitted.

What is claimed is:

1. A flat burner having, at an upper end thereof, a rectangular flame port portion, the flat burner comprising a burner main body constituted by a pair of side plates lying opposite to each other in a lateral direction where a longitudinal direction of the flame port portion is defined as a back-and-forth direction and a width direction of the flame port portion is defined as a lateral direction, the burner main body comprising a mixing tube portion formed at a lower part thereof, and a distribution chamber portion which introduces a fuel-air mixture from the mixing tube portion into the flame port portion, the flame port portion having mounted therein a straightening member with a plurality of straightening plates laterally disposed in parallel with one another, the straightening member having contact portions in which the straightening plates are brought into contact with one another at a plurality of longitudinal positions to thereby longitudinally segregate flame port passages defined by each of the straightening plates, the straightening member further comprising sub-contact portions which bring laterally inner-side straightening plates into contact with one another at each intermediate lower part at a pitch of disposing the contact portions, the laterally inner-side straightening plates defining laterally center-side flame port passages of the flame port portion, wherein a position of lower end of the laterally inner-side straightening plates is below an upper end position of the sub-contact portions, at least lower half of the contact portions of the laterally inner-side straightening plates that are positioned at least in predetermined longitudinal portions is formed into an inverse triangle as seen in the lateral direction, and wherein the predetermined longitudinal portions are those in which the inlet direction of flow of the fuel-air mixture from the distribution chamber portion into the flame port portion longitudinally inclines relative to a vertical direction beyond a predetermined angle.

2. The flat burner according to claim 1, wherein, out of the sub-contact portions, those located at the predetermined longitudinal portions are inclined in a longitudinal direction opposite to the inlet direction of flow of the fuel-air mixture.

3. The flat burner according to claim 1, in which the pitch of disposing the contact portions is narrowed in the longitudinal direction at the predetermined longitudinal portions.

4. The flat burner according to claim 3, wherein, out of the sub-contact portions, those located at the predetermined longitudinal portions are inclined in a longitudinal direction opposite to the inlet direction of flow of the fuel-air mixture.

* * * * *